United States Patent [19]

Matsuda

[11] Patent Number: 5,014,678

[45] **Date of Patent: * May 14, 1991**

[54] CUTTER

[75] Inventor: Yusaku Matsuda, Yamatokoriyama, Japan

[73] Assignee: Sanwa Diamond Industrial Co., Ltd., Japan

[ * ] Notice: The portion of the term of this patent subsequent to Feb. 20, 2007 has been disclaimed.

[21] Appl. No.: 492,067

[22] Filed: Mar. 9, 1990

[30] Foreign Application Priority Data

Mar. 10, 1989 [JP] Japan ..... 1-58878

[51] Int. Cl.[5] ..... B24D 5/00; B28D 1/04

[52] U.S. Cl. ..... 125/15; 51/209 R; 51/206 R

[58] Field of Search ..... 51/207; 125/20, 15

[56] References Cited

U.S. PATENT DOCUMENTS 3,990,338 11/1976 Wikner ..... 125/15 X 4,521,222 6/1985 St. Pierre ..... 51/295

4,909,234 3/1990 Matsuda ..... 125/15

*Primary Examiner*—D. S. Meislin

*Assistant Examiner*—Bruce P. Watson

*Attorney, Agent, or Firm*—Ostrolenk, Faber, Gerb & Soffen

[57] ABSTRACT

The invention is directed to a cutter comprising, a base plate formed by bonding two sheets of thin ring member together, a plurality of projections formed thinner than the base plate on the peripheral edge thereof, an provided with holes and slits which are interposed therebetween, wires passing through the holes so as to connect the projection, and a ring-shaped cutting body including abrasive grains and formed around the projections so as to expose a portion of slits.

Since the projections are formed thinner, abrasions easily take place thereon when the cutter is used. Furthermore, the cutting body at the slits is reinforced by the wires connecting the projections.

Since the base plate is formed by bonding two ring members, it has a large strength as compared with the base plate used in the conventional cutter. Therefore, the base plate hardly breaks when using the cutter.

7 Claims, 3 Drawing Sheets

CUTTER

BACKGROUND OF THE INVENTION

1. Field of the Invention

The present invention relates to a cutter, particularly, it relates to a cutter used when cutting such as stones.

2. Description of the Prior Arts

FIG. 5 is a plan view showing an example of a conventional cutter which forms a background of the present invention, and FIG. 6 is a sectional view taken along the line VI—VI of the cutter shown in FIG. 5, the cutter 1 includes a ring-shaped base plate 2. On the peripheral edge of the base plate 2, there are formed a plurality of projections 4 interposing slits therebetween. Furthermore, around the projections 4 on the peripheral edge of the base plate 2, a ring-shaped cutting body 5 is formed. The cutting body 5 is formed by sintering a metal powder including abrasive grains such as diamond fine particles. The cutting body 5 is formed such that a portion of slits 3 is exposed. The slits 3 serve to cool the cutter 1 with air in use.

When using the cutter 1, it is placed against an object to be cut while being rotated so that the object to be cut is cut by the cutting body 5. At this time, abrasions take place gradually on the cutting body 5 whose inner portion is exposed to maintain the sharpness of the cutter 1.

In such a conventional cutter, however, since the base plate is made of a thin plate its strength is weak. Therefore, when using the cutter there was a possibility that the base plate may bend or cutting can not be effected smoothly due to the vibration.

Also, if the thickness of the projections is made relatively thicker, the projections hardly wear in use of the cutter. As a result, the new inner portion of the cutting body is hindered by the projections to expose on the surface, thereby degrading the sharpness of the cutter.

Moreover, as the mechanical strength of the cutting body formed at the slits is weak there was a possibility to break the cutting body at slits.

SUMMARY OF THE INVENTION

It is, therefore, a primary object of the present invention to provide a cutter which hardly breaks and whose base plate itself is strong and the sharpness is not degraded in use.

The invention is directed to a cutter comprising, a base plate formed by bonding two sheets of thin ring member together, a plurality of projections formed thinner than the base plate on the peripheral edge thereof and provided with holes and slits which are interposed therebetween, wires passing through the holes so as to connect the projection, and a ring-shaped cutting body including abrasive grains and formed around the projections so as to expose a portion of slits.

The base plate is formed by bonding two ring members together. Since the projections are formed thinner, abrasions easily take place thereon when the cutter is used. Furthermore, the cutting body at the slits is reinforced by the wires connecting the projections.

According to the invention, since the base plate is formed by bonding two ring members, it has a large strength as compared with the base plate used in the conventional cutter. Therefore, the base plate hardly breaks when using the cutter.

Also, it is possible to obtain a cutter which hardly breaks and whose sharpness is not degraded in used.

These and other objects, features and advantages of the invention will become more apparent from the following detailed description of the embodiment made with reference to the accompanying drawings.

DESCRIPTION OF THE PREFERRED EMBODIMENT

Figure 1:
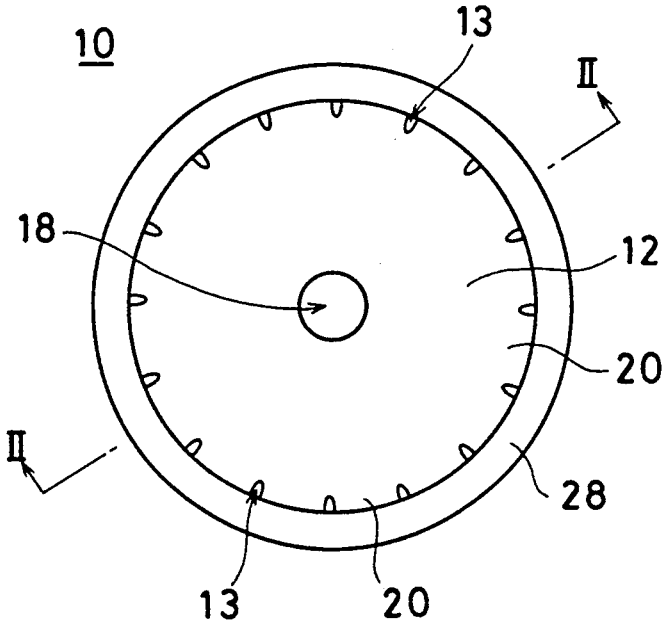
FIG. 1 is a plan view showing an embodiment of the invention.
Figure 2:
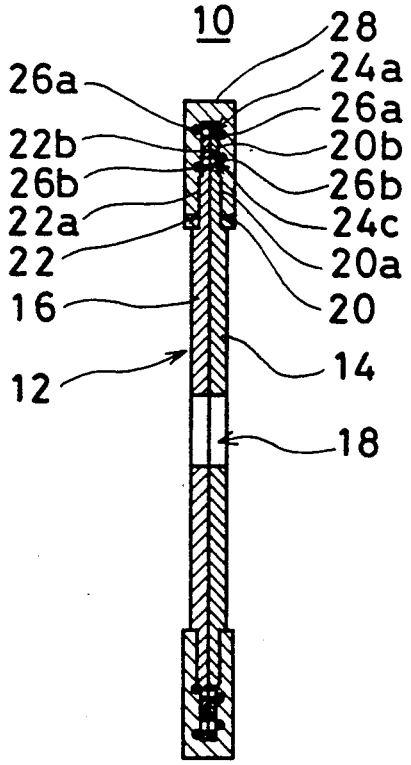
FIG. 2 is a sectional view taken along the line II-II of the embodiment in FIG. 1.

FIG. 1 is a plan view showing an embodiment of the present invention, and FIG. 2 is a sectional view taken along the line II-II of the embodiment of FIG. 1. A cutter 10 includes a base plate 12 having a first ring member 14 and a second ring member 16 of the same size and formed into thin plates by such as stainless steel. In the center portion of the first and second ring members 14, 16 a through hole 18 for inserting a shaft (not shown) therethrough for holding the cutter 10 is formed.

On the peripheral edge of the first ring member 14, a plurality of projections 20 interposing slits 13 therebetween are formed. The projection 20 includes a root portion **20*a* which is thinner than the first ring member 14, and a tip portion 20*b* which is still thinner than the root portion 20*a*. By the root portion 20*a* and the tip portion 20*b*, a step portion is formed on one surface of the first ring member 14, whose other surface being formed into a plane. Similarly, on the peripheral edge of the second ring member 16, a plurality of projections 22 interposing slits 13 therebetween are formed. The projection 22 includes a root portion 22*a* which is thinner than the second ring member 16, and a tip portion 22*b* which is still, thinner than the root portion 22*a*. By the root portion 22*a* and the tip portion 22*b*, a step portion is formed on one surface of the second ring member 16**, whose other surface being formed into a plane.

Figure 3:
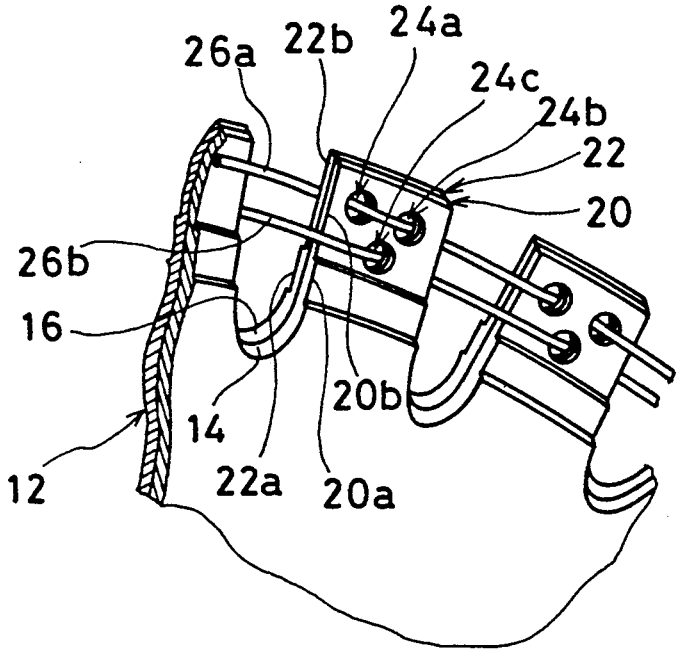
FIG. 3 is a perspective view of an essential portion of a cutter shown in FIG. 1.

The base plate 12 is formed by bonding the other surface of the first ring member 14 formed into the plane, and the other surface of the second ring member 16 formed into the plane together by means of an adhesive. Tip portions **20*b* and 22*b* of the projections 20 and 22 bonded are formed into a thickness of about, for example, 0.1 mm. In the tip portions 20*b* and 22*b* of the projections 20 and 22, there are formed 3 holes 24*a*, 24*b* and 24*b* as shown in FIG. 3. The holes 24*a* and 24*b* are formed and aligned on the peripheral side of the tip portions 20*b* and 22*b* of the projections 20 and 22, and the hole 24*c* is formed o the side of the tip portions toward the root portions 20*a* and 22*a*. The holes 24*a*, 24*b* and 24*c* are formed to have a diameter of, for example, 1 to 1.5 mm. Through the holes 24*a*, 24*b* and 24*c*, two wires 26*a* and 26*b* are passed, thereby connecting a plurality of projections 20 and 22 bonded. One wire 26*a* passes through the holes 24*a* and 24*b* to connect the projections 20 and 22, and the other wire 26*b* passes through the hole 24c to connect the projections 20 and 22. As the wires 26a and 26b**, for example, a stainless wire, a piano wire, a copper wire etc. are used.

Meanwhile, a ring-shaped cutting body 28 is formed around the projections 20 and 22. The cutting body 28 is formed in such a manner that, a ring-shaped compressed powder formed by compressing a mixture of, for example, 1 to 50% of diamond fine particles, 30 to 50% of copper particles, 30 to 50% of iron particles and 5 to 10% of tin particles by volume is arranged around the projections 20 and 22 and sintered. At this time, as the root portions 20a and 22a of the projections 20 and 22 are formed thicker than the tip portions 20b and 22b, the strength of the formed portion of the cutting body 28 is intensified. The cutting body 28 is formed so as to expose a portion of slits 13. By exposing the slits 13, the cutter 10 is cooled by air during the rotation.

When using the cutter 10, it is placed against an object to be cut such as stones while rotating, thereby the object to be cut by the cutting body 28.

In the cutter 10, since the tip portions 20b and 22b of the projections 20 and 22 are formed thinner, they are subjected to abrasion when using the cutter 10. As a result, the tip portions 20b and 22b of the projections 20 and 22 also wear as the abrasion takes place on the cutting body 28, thus allowing the new inner portion of the cutting body 28 to expose on the surface. Accordingly, the sharpness of the cutter 10 can be maintained.

Furthermore, since the plurality of projections 20 and 22 are connected by the wires 26a and 26b, which are present in the slits 13 to reinforce the cutting body 28. Particularly, when the copper wire is used as the wires 26a and 26b, which will fuse together with copper particles contained in a raw material of the cutting body 28 at sintering to secure the wires 26a and 26b to the cutting body 28 firmly. Accordingly, the cutting body 28 formed at the slits 13 hardly breaks. As such, in the cutter 10, the sharpness is not degraded and it is difficult to break as compared with the conventional cutter. Also, since the base plate 12 is formed by bonding the first and second ring members 14 and 16 together, it is stronger as compared with the base plate used in the conventional cutter. Therefore, the base plate 12 hardly breaks when using the cutter 10.

In the embodiment described above, though these holes 24a, 24b and 24c are formed respectively in the tip portions 20b and 22b of the projections 20 and 22, the number of holes may be changed arbitrarily.

In the aforesaid embodiment, though the diamond fine particles are employed as abrasive grains used in the cutting body 28, the abrasive grains such as cubic boron nitride (CBN) may be used alternatively.

Figure 4:
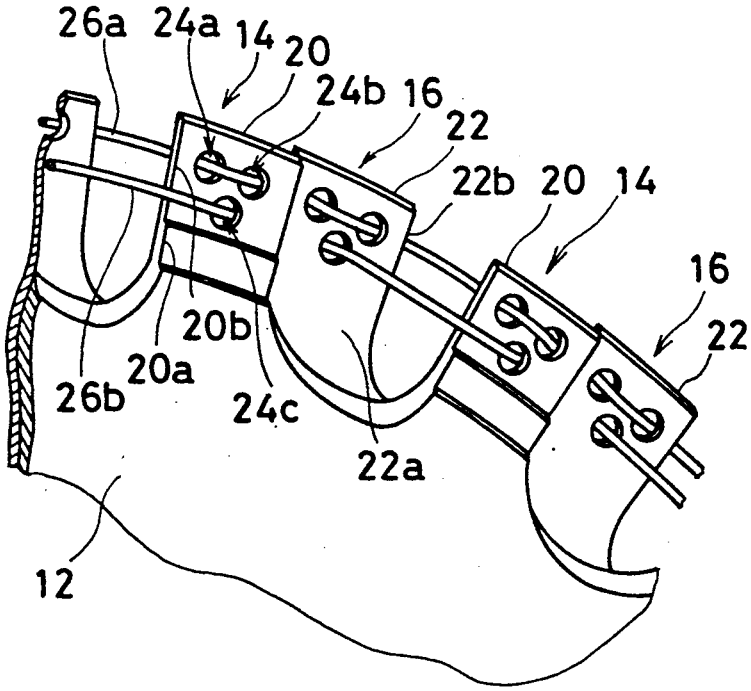
FIG. 4 is a perspective view of an essential portion showing a modified example of a cutter shown in the embodiment in FIG. 1.
Figure 5:
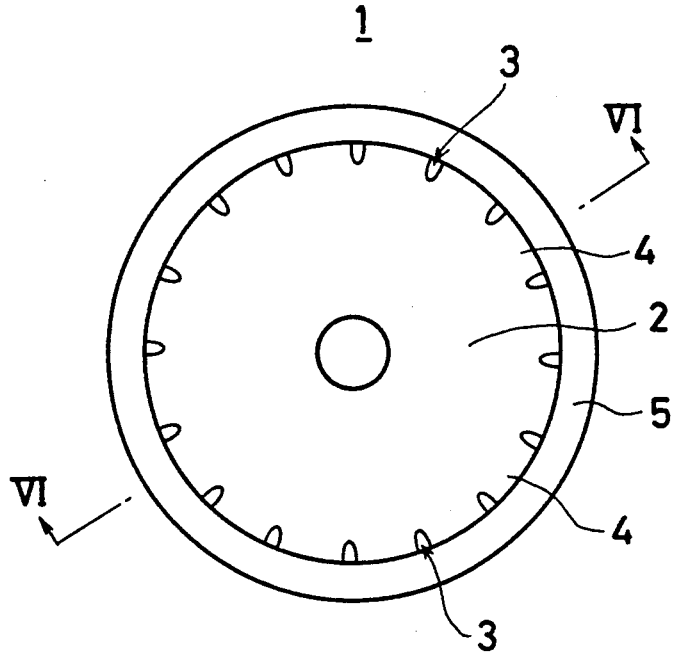
FIG. 5 Prior Art
FIG. 5 is a plan view showing an example of a conventional cutter which is a background of the invention.
Figure 6:
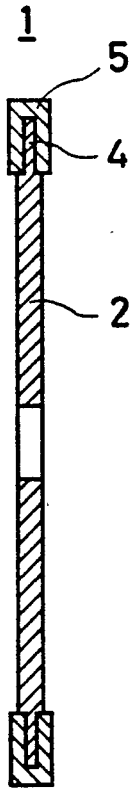
FIG. 6 Prior Art
FIG. 6 is a sectional view taken along the line VI—VI of a conventional cutter shown in FIG. 5.

Moreover, in the embodiment aforementioned, though the base plate 12 is formed by bonding the projections 20 and 22 of the first and second ring members 14 and 16, as shown in FIG. 4, it may be formed by shifting the projections 20 and 22 of the first and second ring members 14 and 16 circumferentially so as to be overlapped.

While the present invention has been particularly described and illustrated, it is to be understood that such description is for illustrative purpose and by way of example and not of limitation. The spirit and scope of the invention, therefore, is to be determined solely by appended claims.

I claim:

1. A cutter comprising, a base plate formed of two thin plates with through holes in them defining each said plate into a ring member and said two ring members being bonded together to form the plate;

a plurality of projections formed thinner than the thickness of the remainder of said base plate and disposed on the peripheral edge of said base plate, with slits projecting inward from said peripheral edge of said base plate defining said projections between neighboring ones of said slits; holes defined in said projections;

wires passing through said holes for connecting said projections; and a ring-shaped cutting body including abrasive grains and formed around said projections, said cutting body extending radially inward a distance so as to expose a radially inward portion of said slits.

2. A cutter in accordance with claim 1, wherein said two ring members are bonded together with an adhesive.

3. A cutter in accordance with claim 1, wherein each said projection includes a thin root portion and a tip portion outward of said root portion and which is still thinner than said root portion.

4. A cutter in accordance with claim 3, wherein each said ring member has an outward facing surface and another inward facing surface facing the other inward facing surface of the other said ring member, each said outward facing surface of each said ring member is formed with a step portion by said root portion and said tip portion, and said other surface of each said ring member is formed into a plane.

5. A cutter in accordance with claim 1, wherein said cutting body is formed of a sintered ring-shaped compressed powder which is formed of a compressing mixture including abrasive grains and copper particles.

6. A cutter in accordance with claim 1, wherein said abrasive grains include diamond fine particles.

7. A cutter in accordance with claim 1, wherein said wire is formed by a copper wire.

* * * * *